US007406938B2

(12) United States Patent
Lawes

(10) Patent No.: US 7,406,938 B2
(45) Date of Patent: Aug. 5, 2008

(54) COOLING MECHANISMS FOR ROTARY VALVE CYLINDER ENGINES

(75) Inventor: Keith Trevor Lawes, Poole (GB)

(73) Assignee: RCV Engines Limited, Wimborne (GB)

( * ) Notice: Subject to any disclaimer, the term of this patent is extended or adjusted under 35 U.S.C. 154(b) by 0 days.

(21) Appl. No.: 10/573,111

(22) PCT Filed: Sep. 20, 2004

(86) PCT No.: PCT/GB2004/004016

§ 371 (c)(1),
(2), (4) Date: Mar. 23, 2006

(87) PCT Pub. No.: WO2005/031119

PCT Pub. Date: Apr. 7, 2005

(65) Prior Publication Data

US 2007/0034179 A1 Feb. 15, 2007

(30) Foreign Application Priority Data

Sep. 24, 2003 (GB) ..... 0322353.4

(51) Int. Cl.
*F02B 75/20* (2006.01)
*F01L 5/06* (2006.01)

(52) U.S. Cl. ..... 123/190.1; 123/59.3; 123/65 VA

(58) Field of Classification Search ..... 123/59.3, 123/65 VA, 490.1, 80 C, 43 R
See application file for complete search history.

(56) References Cited

U.S. PATENT DOCUMENTS

| | | | | |
|---|---|---|---|---|
| 1,614,634 | A | 1/1927 | Storle | |
| 1,649,509 | A | 11/1927 | Charter | |
| 5,191,863 | A | 3/1993 | Hagiwara | |
| 7,131,405 | B2 * | 11/2006 | Lawes | 123/59.3 |

FOREIGN PATENT DOCUMENTS

| | | | |
|---|---|---|---|
| DE | 669 345 | C | 12/1938 |
| EP | 0 016 381 | B1 | 10/1980 |
| GB | 2 020 739 | A | 11/1979 |
| GB | 2 129 488 | A | 5/1984 |
| WO | WO 98/03781 | A1 | 1/1998 |
| WO | WO 02/27165 | A1 | 4/2002 |
| WO | WO 03/062615 | A1 | 7/2003 |

* cited by examiner

*Primary Examiner*—Stephen K. Cronin
*Assistant Examiner*—Hyder Ali
(74) *Attorney, Agent, or Firm*—Christensen O'Connor Johnson Kindness PLLC

(57) ABSTRACT

A cooling mechanism for a rotary valve cylinder engine 1 comprising a rotary valve cylinder 3 rotatably mounted within an outer cylindrical valve element 8, the rotary valve cylinder 3 and the outer cylindrical valve element 8 each being formed with a respective valve port 51, 71, 81, the rotary valve cylinder 3 being rotatable relative to the outer cylindrical valve element 8 to a position in which the ports 51, 71, 81 are aligned, the cooling mechanism comprising fluid passages 11, 28 formed in the rotary valve cylinder 3 and the outer cylindrical valve element 8 through which, in use, cooling oil flows.

51 Claims, 3 Drawing Sheets

COOLING MECHANISMS FOR ROTARY VALVE CYLINDER ENGINES

The present invention relates to cooling mechanisms for rotary valve cylinder engines.

A rotary valve cylinder engine comprises a rotary valve cylinder having an internal combustion chamber formed with a valve port, and an outer cylindrical element formed with at least an inlet valve port and an exhaust valve port. The rotary valve cylinder is disposed within the outer cylindrical element and is rotatable relative to the outer cylindrical element to a position in which the rotary valve cylinder valve port is aligned with either the inlet or exhaust valve port of the outer cylindrical element. When so aligned an inlet charge, or exhaust gas, can flow through the aligned ports into or out of the combustion chamber of the rotary valve cylinder.

Whilst the rotary valve cylinder engine has now been proven to be a practical engine design, in early versions of the engine it has been found that the volumetric efficiency of the engine can be comparatively low. We have discovered that this is mainly due to excessive heating of the inlet charge by the inlet manifold and rotary valve cylinder. In addition some components within the engine were found to be getting excessively hot, in particular the rotary valve cylinder. As a result it has been found that to optimise the performance of the rotary valve cylinder engine , the rotary valve cylinder must be kept as cool as possible.

It has been proposed in earlier versions of the engine to carry out the cooling by pumping fluid through the outer cylindrical valve element of the engine, and over the lower external surfaces of the rotary valve cylinder.

However this cooling system not only provided inadequate cooling of the rotary valve cylinder, it also caused significant problems with fluid leaks leading to excessive oil consumption.

According to a first aspect of the invention there is provided a cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising at least one passage formed in the rotary valve cylinder through which, in use, cooling fluid flows.

Preferably the fluid cooling passages comprise a plurality of passages which, when viewed along the axis of rotation of the rotary valve cylinder, extend axially substantially equispaced around the circumference of the rotary valve cylinder wall and around the circumference of the rotary cylinder.

Preferably the rotary valve cylinder comprises a circular top surface which closes one end of the rotary valve cylinder to define a combustion chamber between the underside of the top surface and the top of a piston located inside the rotary valve cylinder, the cooling fluid being forced over the circular top surface of the rotary valve cylinder to cool the circular top surface of the rotary valve cylinder. The cooling fluid is preferably the engine lubrication oil.

According to a second aspect of the invention there is provided a cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising a heat sink mounted directly to an upper part of the rotary valve cylinder so as to rotate with the rotary valve cylinder, the heat sink being otherwise exposed to the open air.

Preferably the heat sink comprises a separate component mounted directly to the top of the rotary valve cylinder. Alternatively the heat sink is formed integrally with the rotary valve cylinder so that the heat sink and rotary valve cylinder together comprise a single component.

According to a third aspect of the invention there is provided a cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising thermal insulation means at an inner surface of the valve port formed on the outer cylindrical valve element, the thermal insulation means being operative to minimise the thermal energy transferred between the outer cylindrical valve element and any gas flowing through the port.

Preferably the valve port formed in the second cylindrical valve element comprises an inner surface against which the gas would ordinarily flow, the thermal insulation means substantially covering the inner surface such that the gas instead flows against the thermal insulation means.

Preferably a manifold is provided to convey gas to or from the valve port in the outer cylindrical valve element, the thermal insulation means comprising a protrusion on the inlet manifold which protrudes into the valve port towards the rotary valve cylinder.

Instead of the manifold and protrusion, the thermal insulation means can alternatively be formed from a separate tubular component made from a thermally insulating material, said tubular component being adapted to be received in the valve port so as to substantially cover the inner surface of the valve port.

Embodiments of the invention will now be described by way of example only with reference to the accompanying drawings in which.

Figure 1:
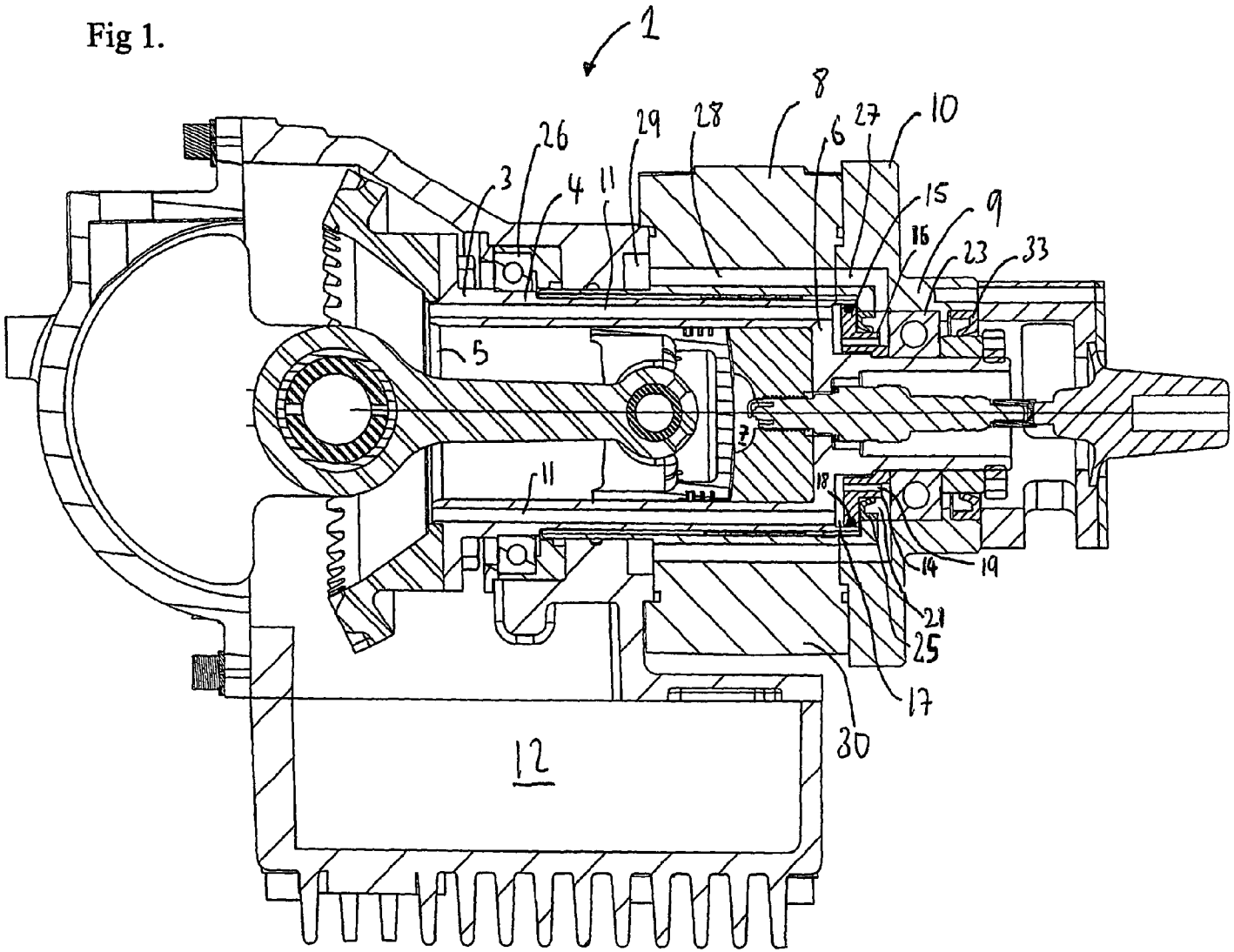
FIG. 1 is a cross sectional side view of a rotary cylinder valve engine provided with a cooling mechanism in accordance with the current invention.
Figure 2:
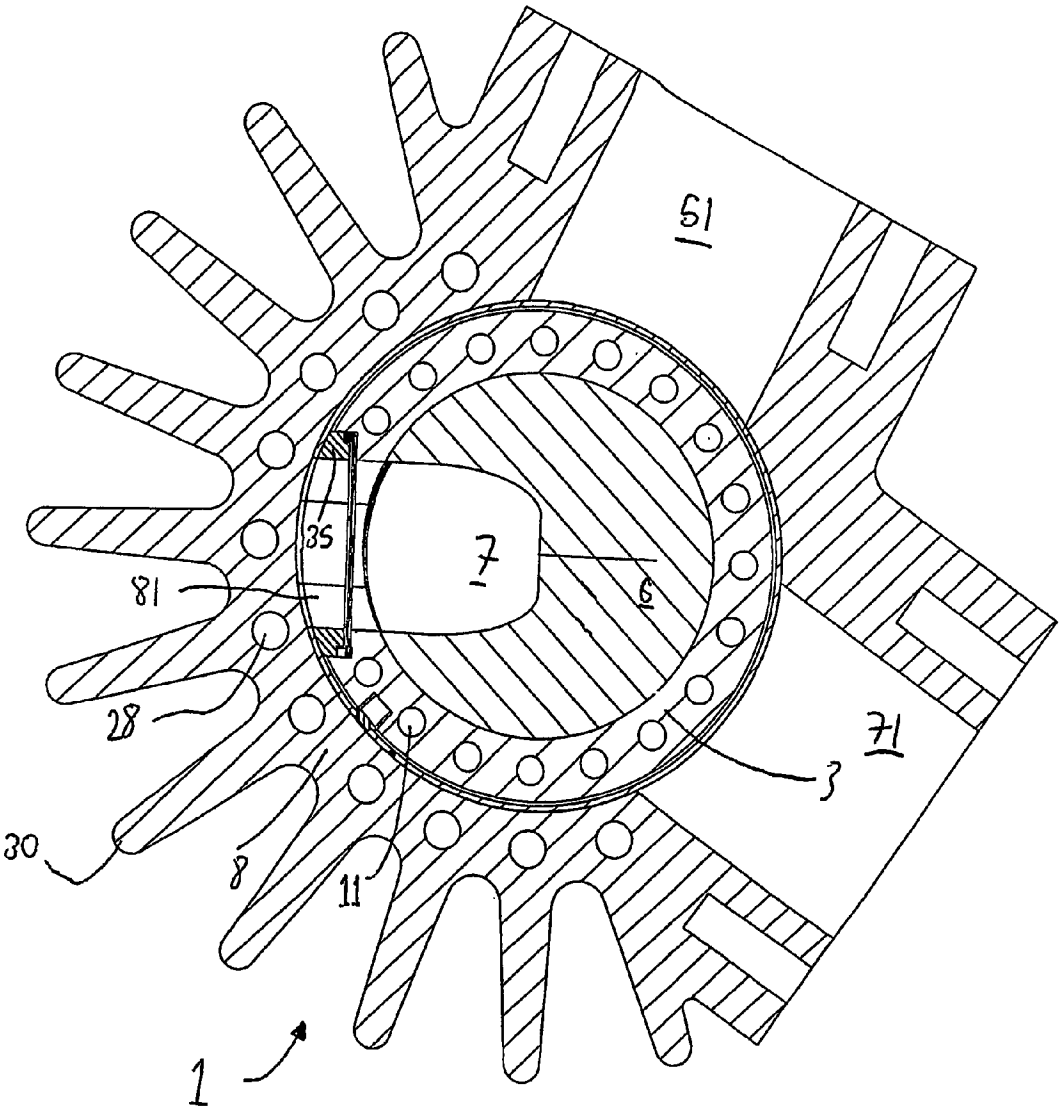
FIG. 2 is a cross sectional top view of the rotary cylinder valve engine of FIG. 1 taken through line A-A.

Referring initially to FIGS. 1 and 2, a rotary valve cylinder engine 1 comprises a rotary valve cylinder 3 comprising a cylindrical outer wall 4 having an open lower end 5 and a closed upper end 6. The under-surface of the closed upper end 6 comprises the ceiling of a combustion chamber 7 defined within the rotary valve cylinder 3. The rotary valve cylinder 3 is rotatably mounted within a fixed outer cylindrical valve element 8 that is formed with an inlet valve port 51 and an exhaust valve port 71. The outer cylindrical valve element 8 comprises a cylinder head of the engine.

The rotary valve cylinder 3 is formed with a single valve port 81 in communication with the combustion chamber 7, the rotary valve cylinder 3 being rotatable to a position in which the single port is aligned with either the inlet or the exhaust port 51, 71 of the cylinder head 8. A piston assembly reciprocates within the rotary valve cylinder 3, the combustion chamber 7 being defined between the top of the piston of the piston assembly and the under surface of the closed upper end 6.

A cylindrical top cap 9 has a radially outwardly extending peripheral flange 10 that secures the top cap 9 to the cylinder head 8 so as to seal the rotary cylinder valve 3 within the cylinder head 8. Such an engine is well known.

The rotary valve cylinder 3 is formed with internal oil cooling passages 11 which comprise bores that extend through the length of the rotary cylinder wall 4. The ends of the passages 11 that are remote from the upper closed end 6 of the rotary valve cylinder 3 are in communication with an oil sump 12 at the base of the engine. This communication occurs via a void at the base of the crank case and into which the oil from the passages 11 enters. The void is located above the sump 12 and the oil from the void then flows into the sump 12. The other ends of the passages 11 extend through the closed upper end 6 of the rotary valve cylinder 3 so as to be in communication with the exterior of the rotary valve cylinder 3. The oil cooling passages 11 are equispaced within the cylinder wall 4 so that, when viewed in plan, the passages 11 are equispaced about the circumference of the rotary valve cylinder 3 as can be seen in FIG. 2.

A hollow, substantially cylindrical plug 14 is provided and comprises a cylindrical base 15 and a cylindrical boss 16 extending from the base 15. The cylindrical base 15 is secured to the closed upper end 6 of the rotary 10 valve cylinder 3 to define an upper oil chamber 17 between the plug 14 and the top surface of the upper end 6 of the rotary valve cylinder 3. The periphery of the plug 15 sealingly engages the periphery of the top surface of the rotary valve cylinder 3 using an O-ring 18 or the like.

The plug 14 is formed with a plurality of channels 19 which extend 15 though the base 15 and boss 16 of the plug 14 in a direction parallel with the longitudinal axis of the plug 14. The channels 19 are in communication with the passages 11 formed in the rotary valve cylinder 3. An annular cavity 21 is defined between the top of the plug 14 and an upper rotational bearing 23 which is mounted in the top cap 9. A lower rotational bearing 26 Is provided at the lower end of the rotary valve cylinder 3, the rotary valve cylinder 3 being mounted on both rotational bearings 23, 26. An upper oil seal 33 is provided above the upper rotational bearing 23 and the radially outer surface of oil seal 33 15 secured to the inside of the body of the top cap 9. The radially inner surface of the oil seal 33 sealingly engages an uppermost end of the rotary valve cylinder 3.

An annular oil seal 25 is located in the annular cavity 21, a radially outer surface of the oil seal 25 being secured to the internal sides of the flange 10 of the top cap 9. A radially inner sealing surface of the oil seal sealingly bears against the boss 16 of the plug 14 to prevent oil from leaking from the annular cavity 21 and around the outside of the rotary valve cylinder 3. Because the radially inner sealing surface of the annular oil seal 25 bears against the relatively small diameter boss 16 of the plug 14, the oil seal 25 can itself be made of relatively small diameter so as to keep the sealing area of the radially inner sealing surface of the oil seal 25 to a minimum. This reduces the cost of the oil seal 25 and also reduces the frictional losses that occur through the sealing engagement of the radially inner sealing surface of the oil seal 25 with boss 16 of the plug 14.

The annular cavity 21 is in communication with linking passages 27 formed in the top cap 9, the linking passages 27 extending into passageways 28 formed in the cylinder head 8 which lead to an annular recess 29 defined at the base of the cylinder head 8. The annular recess 29 is in communication with the sump 12 in the base of the engine. The passageways 28 are equispaced, when viewed in plan, about the circumference of the cylinder head 8 as can best be seen in FIG. 2.

The cylinder head 8 is provided with cooling means comprising a plurality of equispaced, radially outwardly extending cooling fins 30 which are exposed to the air surrounding the engine.

In use, oil is pumped from the oil sump 12 by an oil pump (not shown) into the annular recess 29 at the base of the cylinder head 8. Oil then passes up through the oil. passageways 28 in the cylinder head 8. FIG. 2 shows that the oil passageways 28 are close to the cooling fins 30. As the oil flows near the fins 30, heat is passed from the oil to the cooling fins 30 and thence to cooling air being forced over the cooling fins 30, This air flow being either due to a fan (not shown) or the movement of the engine when, for example, mounted in a vehicle. It is understood that a second cooling medium, for example water, could be passed over the fins 30 to conduct heat away.

The oil then passes through the linking passages 27 in the top cap 9 and thence radially inwardly into the annular cavity 21 at the top of the rotary valve cylinder 3. The oil lubricates the upper cylinder bearing 23. The upper oil seal 33 prevents oil from leaking from the top of the engine and the annular oil seal 25 prevents oil from leaking down the sides of the rotary valve cylinder 3 and into the region of the valve port.

Because the annular oil seal 25 seals against the relatively small diameter of the boss 16 of the plug 14, the oil seal 25 has a significantly smaller internal diameter than the external diameter of the valve seal 35 which seals the periphery of the valve port in the rotary valve cylinder 3 against the cylinder head 8. This reduces frictional losses in the oil seal 25.

The oil then passes through the channels 19 in the top plug 14 and into the upper oil chamber 17. Oil in the upper oil chamber 17 cools the closed upper end 6 of the rotary valve cylinder 3 and thus conducts heat away from the combustion chamber 7.

The oil then flows into the oil cooling passages 11 formed in the rotary valve cylinder wall 4, towards the base of the rotary valve cylinder 3 so as to cool the rotary valve cylinder 3. The oil then flows back to the oil sump 12.

Whilst the above describe in detail a cooling mechanism where the oil is fed into the top of the rotary valve cylinder 3 and exits from the base of the rotary valve cylinder 3, it is understood that it would be possible, with suitable oil feed means to the base of the rotary valve cylinder 3, to feed the oil through the rotary valve cylinder 3 in the reverse direction, that is to feed oil in at the base of the rotary valve cylinder 3, the oil then flowing through the upper oil chamber 17, exiting through the upper closed end 6 of the rotary valve cylinder 3 and flowing back down through the oil cooling passages 27 in the top cap 9 and the passageways 28 in the cylinder head 8 to return to the sump 12.

The improvements described above cool the rotary valve cylinder 3 directly. This both improves cooling of the rotary valve cylinder 3 and also simplifies and improves the oil control method required for the engine. The use of the same fluid, oil, for cooling and lubrication simplifies the engine design and also assists uniformity of cooling. In an alternative embodiment (not shown), water is used as the cooling medium flowing through the passages 11, 27, 28 in which case further seals to separate the water from the lubricating oil are necessary.

Figure 3:
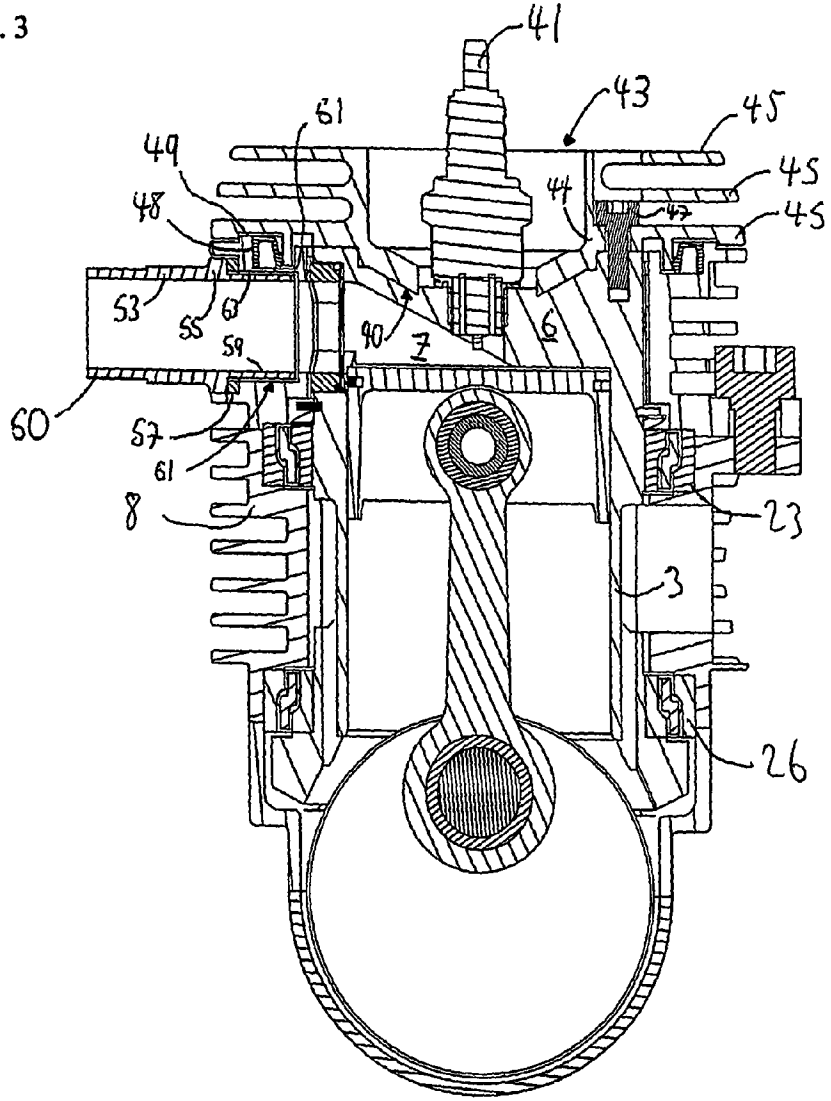
FIG. 3 is a cross sectional side view of another rotary cylinder valve engine provided with cooling mechanisms in accordance with the current invention.

Referring now to FIG. 3, another embodiment of a rotary cylinder valve engine is shown with like features being given like references.

In this embodiment the cooling passages 11, linking passages 27, the passageways 28, cylinder head fins 30, the top cap 9 and the oil sump 12 are omitted.

The rotational bearings 23, 26 in this embodiment, are both positioned below the upper closed end 6 of the rotary valve cylinder 3 and below the valve port formed in the rotary valve cylinder 3. Thus the upper bearing 23 is below but adjacent the valve port, whilst the lower bearing 26 is positioned towards the base of the rotary valve cylinder 3. The two bearings 23, 26 and the rotary valve cylinder 3 are assembled into the cylinder head 8 using a circlip and a bearing preload spring.

The top surface of the upper closed end 6 of the rotary valve cylinder 3 is radially inwardly tapered so as to define a concave recess 40 at the top of the rotary valve cylinder 3. The spark plug 41 extends axially through the base of the concave recess 40 and into the combustion chamber 7 of the engine.

In this embodiment the cooling mechanism comprises an external heat sink 43, which is directly attached to the closed upper end 6 of the rotary valve cylinder 3 at the concave recess 40 so as to rotate with the rotary valve cylinder 3.

The heat sink 43 comprises a cylindrical body 44 having a plurality of annular flanges 45 which extend radially outwardly of the cylindrical body 44. Each flange 45 is spaced from adjacent flanges 45 so that the flanges comprise cooling flanges. The base of the cylindrical body 44 tapers downwardly so as to be of a shape to mate directly with the conical recess 40 at the top of the rotary valve cylinder 3. Thus the heat sink 43 extends axially away from the upper closed end 6 of the rotary valve cylinder 3 whilst the flanges 45 extend radially outwardly so as to be of a diameter greater than the diameter of the rotary valve cylinder 3. The heat sink 43 is thus of mushroom shaped transverse cross section.

Bolts 47 are provided to secure the heat sink 43 to the rotary valve cylinder 3 although any other suitable attachment means can alternatively be provided. An annular oil seal 48 is provided between the heat sink 43 and the cylinder head 8, the oil seal 48 being located in an annular groove 49 formed in a lower flange 45 of the heat sink 43.

The heat sink 43 could alternatively be formed integrally with the rotary valve cylinder 3 so as to comprise an extension to the rotary valve cylinder 3. It is important that a good thermal joint is provided between the heat sink 43 and rotary valve cylinder 3.

This can be accomplished by accurately matched mating surfaces and a suitable jointing compound.

The external rotating heat sink 43 is in free air, providing direct cooling 5 means for the rotary valve cylinder 3. The air flow over the heat sink 43 is provided by a fan (not shown), propeller (not shown) or the movement of the engine if, for example, mounted in a vehicle, and is augmented by the rotating of the heat sink 43 with the rotary valve cylinder 3 which will increase thermal transmission to the air.

The heat sink 43 is in direct thermal contact with the rotary valve cylinder 3. The magnitude of the thermal contact area has been increased by the repositioning of the rotary valve cylinder bearings 23, 26, because this repositioning allows the upper closed end 6 of the rotary valve cylinder 3 to be free to accept the heat sink 43 over as large an area of the rotary valve cylinder 3 as possible. This enhances the cooling function provided by the heat sink 43.

In addition, it will be appreciated that the thickness of the upper closed end 6 of the rotary valve cylinder 3 is minimised so that the distance between the combustion chamber 7 and the top surface of the closed upper end 6 of the rotary valve cylinder 3 to which the heat sink 43 is attached is minimised.

In addition to the heat sink 43, the engine of FIG. 3 comprises a further cooling mechanism for minimising thermal energy transfer across an inlet port or an exhaust port of the outer cylindrical valve element by providing thermal insulation means that covers the inner surface of the port in question. Although not shown, this further cooling mechanism can also be incorporated in the embodiment of FIG. 1

The example shown is for an inlet port formed in the cylinder head 8 and with which the valve port formed in the rotary valve cylinder 3 can be aligned. However, the following description applies equally to any other port formed in the cylinder head 8 including the exhaust port.

An inlet manifold 50 is provided which is secured to the inlet valve port 51 and allows passage of inlet charge into the engine from a carburettor or other fuelling device (not shown). The inlet manifold 40 at the region of the inlet valve port 51 comprises a tubular region 53 of rectangular transverse cross section, formed with an external spigot 55 that abuts against a hollow, thermally insulating mounting block 57 that is secured to the cylinder head 8. This reduces direct thermal conduction from the cylinder head 8 to the inlet manifold 50. The mounting block 57 is made from a heat resistant plastic or other thermally insulating material.

A tubular protrusion 59, also of rectangular transverse cross section, of the inlet manifold 50 extends from the spigot 55 and protrudes into the inlet valve port 51 in the cylinder head 8. The protrusion 59 extends into the inlet valve port 51 as close to the rotary valve cylinder 3 as is mechanically feasible thus covering substantially all of the inner surface 61 of the inlet valve port 51. ft will be appreciated that the valve port 51 and the inner surface 61 thereof are both of rectangular transverse cross section, that is when viewed along the longitudinal axis of the valve port 51. The width and height of the outside of the manifold protrusion 59 are less than the width and height of the inner surface 61 of the inlet valve port 51 such that a small air gap 63 is provided between the outside of the inlet manifold protrusion 59 and the inner surface 61 of the inlet port 51, This air gap 63 providing a thermal insulator. In use, when fitted to the inlet port 51, the hollow insulating mounting block 57, the thermally insulating protrusion 59 and the thermally insulating air gap 63 minimise the thermal energy transferred to the inlet charge from the cylinder head 8 and other external engine components, thus maximising the volumetric efficiency of the inlet charge.

When fitted to an exhaust port the tubular insulating block 57, the thermally insulating protrusion 59 and the thermally insulating air gap 63 minimise the thermal energy transferred to the cylinder head 8 and other external engine components from the exhaust charge, thus reducing the cooling requirement of the engine. This reduces, in use, the overall temperature of the engine.

The invention claimed is:

1. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising at least one passage formed in the rotary valve cylinder through which, in use, cooling fluid flows, wherein the rotary valve cylinder comprises a circular top surface which closes one end of the rotary valve cylinder to define a combustion chamber between the underside of the top surface and the top of a piston located inside the rotary valve cylinder, the cooling fluid being forced over the circular top surface of the rotary valve cylinder to cool the circular top surface of the rotary valve cylinder, and the rotary valve cylinder comprises a cylindrical cylinder wall in which the fluid cooling passage is formed.

2. A cooling mechanism according to claim 1, wherein the fluid cooling passage in the rotary cylinder wall extends substantially along the length of the rotary cylinder wall.

3. A cooling mechanism according to claim 1, wherein the fluid cooling passage extends in a direction substantially parallel to the rotational axis of the rotary valve cylinder.

4. A cooling mechanism according to claim 1, wherein the rotary valve cylinder is formed with a plurality of fluid cooling passages.

5. A cooling mechanism according to claim 1, wherein the fluid cooling passages, when viewed in the direction of the axis of rotation of the rotary valve cylinder, extend substantially around the circumference of the rotary valve cylinder wall.

6. A cooling mechanism according to claim 4 or 5, wherein the fluid cooling passages in the rotary cylinder are substantially equispaced around the circumference of the rotary cylinder.

7. A cooling mechanism according to claim 1, wherein the fluid cooling passage or passages are defined between an inner cylinder which is received within an outer cylinder to together define the rotary valve cylinder, at least one of the inner or outer cylinders being formed with a groove or grooves which define(s) the oil cooling passage or passages.

8. A cooling mechanism according to claim 1, wherein the fluid flow path includes passageways formed within the outer cylindrical valve element.

9. A cooling mechanism according to claim 1, wherein, in use, the cooling fluid enters the rotary cylinder at an upper end of the rotary valve cylinder at a position adjacent the top surface of the rotary valve cylinder.

10. A cooling mechanism according to claim 1, wherein the cooling fluid exits from a lower end of the rotary valve cylinder at a position distal from the circular top surface of the rotary valve cylinder.

11. A cooling mechanism according to claim 1, wherein the outer cylindrical valve element is provided with cooling means operative to transfer thermal energy from the fluid to a liquid cooling medium contained in a jacket formed in the outer cylindrical valve element.

12. A cooling mechanism according to claim 11, wherein the jacket is adjacent the fluid passageways formed in the outer cylindrical valve element.

13. A cooling mechanism according to claim 11 or 12, wherein the liquid cooling medium is a water based cooling medium.

14. A cooling mechanism according to claim 1, wherein the fluid cooling medium is oil.

15. A cooling mechanism according to claim 14, wherein the oil is the engine lubrication oil.

16. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising at least one passage formed in the rotary valve cylinder through which, in use, cooling fluid flows, wherein the rotary valve cylinder comprises a circular top surface which closes one end of the rotary valve cylinder to define a combustion chamber between the underside of the top surface and the top of a piston located inside the rotary valve cylinder, the cooling fluid being forced over the circular top surface of the rotary valve cylinder to cool the circular top surface of the rotary valve cylinder.

17. A cooling mechanism according to claim 16, wherein an upper part of the rotary valve cylinder is formed with at least one channel or channels around the periphery of the circular top surface through which, in use, the cooling fluid flows.

18. A cooling mechanism according to claim 17, wherein the fluid enters the rotary valve cylinder at a feed point at the top surface of the rotary valve cylinder, a fluid seal being provided immediately below the fluid feed point, the fluid seal, in use, resisting any fluid flow from the fluid feed point into the region of the valve port of the rotary valve cylinder.

19. A cooling mechanism according to claim 18, wherein the fluid enters the top surface of the rotary valve cylinder through a channel formed in a boss that is of smaller diameter than the outer diameter of the rotary valve cylinder.

20. A cooling mechanism according to claim 19, wherein the upper fluid cooling chamber is positioned between the boss and the top surface of the rotary valve cylinder so that the fluid flows down through the channel formed in the boss so as to flow within the inner diameter of the fluid seal, and into the upper fluid cooling chamber.

21. A cooling mechanism according to claim 16, wherein an upper fluid cooling chamber is formed adjacent the circular top surface of the rotary valve cylinder.

22. A cooling mechanism according to claim 21, wherein the fluid cooling passage or passages in the wall of the rotary valve cylinder communicate with the upper fluid cooling chamber via the channel or channels formed in the upper part of the rotary valve cylinder.

23. A cooling mechanism according to claim 21, wherein the fluid cooling passage or passages in the wall of the rotary valve cylinder communicate with the upper fluid cooling chamber at the periphery of the upper fluid cooling chamber.

24. A cooling mechanism according to according to claim 21, wherein the upper fluid cooling chamber is formed by a substantially hollow plug at the top surface of the rotary valve cylinder, the periphery of the plug being sealed against the periphery of the top surface of the rotary valve cylinder, the fluid cooling chamber being defined between the walls and ceiling of the plug and the top surface of the rotary valve cylinder.

25. A cooling mechanism according to claim 21, wherein, in use, the fluid flows through the upper fluid cooling chamber so as to directly contact the top surface of the rotary valve cylinder to provide direct cooling of the top surface of the rotary valve cylinder, which in turn cools the combustion chamber roof.

26. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising at least one passage formed in the rotary valve cylinder through which, in use, cooling fluid flows, wherein the rotary valve cylinder comprises a circular top surface which closes one end of the rotary valve cylinder to define a combustion chamber between the underside of the top surface and the top of a piston located inside the rotary valve cylinder, the cooling fluid being forced over the circular top surface of the rotary valve cylinder to cool the circular top surface of the rotary valve cylinder, wherein the outer cylindrical valve element is provided with cooling means operative to transfer thermal energy from the fluid to the outer cylindrical valve element and into the air surrounding the second cylindrical valve element.

27. A cooling mechanism according to claim 26, wherein the cooling means comprises at least one fin extending outwardly from the outer cylindrical valve element.

28. A cooling mechanism according to claim 27, wherein the cooling means comprises a plurality of fins that are relatively spaced around at least part of the outer cylindrical valve element.

29. A cooling mechanism according to claim 26, wherein the fluid flow path includes passageways formed within the outer cylindrical valve element adjacent the cooling means to maximize the transfer of thermal energy from the fluid to the outer cylindrical valve element and to the air surrounding the outer cylindrical valve element.

30. A cooling mechanism according to claim 29, wherein the fluid passageways formed in the outer cylindrical valve element are substantially equispaced around the outer cylindrical valve element.

31. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising a heat sink mounted directly to an upper part of the rotary valve cylinder so as to rotate with the rotary valve cylinder, the heat sink being otherwise exposed to the open air.

32. A cooling mechanism according to claim 31, wherein the heat sink comprises a separate component mounted directly to the top of the rotary valve cylinder.

33. A cooling mechanism according to claim 31, wherein the heat sink is formed integrally with the rotary valve cylinder so that the heat sink and rotary valve cylinder together comprise a single component.

34. A cooling mechanism according to according to claim 31, wherein the upper part of the rotary valve cylinder comprises a circular top surface below which is provided a combustion chamber.

35. A cooling mechanism according to claim 34, wherein to maximize the heat transferred to the heat sink, the diameter of the part of the circular top surface of the rotary valve cylinder to which the heat sink is attached is at least 50% of the external diameter of the rotary valve cylinder.

36. A cooling mechanism according to claim 34 or 35, wherein the base of the heat sink is at least 50% of the external diameter of the rotary valve cylinder.

37. A cooling mechanism according to claim 35, wherein, to maximize the heat transferred to the heat sink, the diameter of the part of the top surface of the rotary valve cylinder to which the heat sink is attached is at least 75% of the external diameter of the rotary valve cylinder.

38. A cooling mechanism according to claim 31, wherein the rotary valve cylinder is mounted on the outer cylindrical valve element by bearing means, the bearing means being positioned distal from the upper part of the rotary valve cylinder so that the valve port formed in the rotary valve cylinder is between the upper part and the bearing means.

39. A cooling mechanism according to claim 38, wherein the bearing means comprises two relatively spaced bearings.

40. A cooling mechanism according to claim 39, wherein one of the two bearings is located below but adjacent the valve port of the rotary valve cylinder, whilst the other bearing is located at a lower part of the rotary valve cylinder distal from the valve port of the rotary valve cylinder.

41. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising thermal insulation means at an inner surface of the valve port formed on the outer cylindrical valve element, the thermal insulation means being operative to minimize the thermal energy transferred between the outer cylindrical valve element and any gas flowing through the port.

42. A cooling mechanism according to claim 41, wherein the valve port formed in the second cylindrical valve element comprises an inner surface, the thermal insulation means substantially covering the inner surface such that the gas flows against the thermal insulation means.

43. A cooling mechanism according to claim 41 or 42, wherein the inner surface of the valve port is of rectangular transverse cross section when viewed along the longitudinal axis of the valve port.

44. A cooling mechanism according to claim 41, wherein a manifold is provided to convey gas to or from the valve port in the outer cylindrical valve element, the thermal insulation means comprising a protrusion on the inlet manifold which protrudes into the valve port towards the rotary valve cylinder.

45. A cooling mechanism according to claim 44, wherein the protrusion extends into the valve port towards the rotary valve cylinder so as to be adjacent but not in contact with the rotary valve cylinder.

46. A cooling mechanism according claim 44 or 45, wherein the protrusion is spaced from the inner surface of the valve port so that a small air gap is provided between the radially outer surface of the protrusion and the inner surface of the inlet port, the air providing further thermal insulation between fit gas and the outer cylindrical valve element.

47. A cooling mechanism according to claim 44, wherein the manifold is mounted on the outer cylindrical valve element by mounting means formed from a thermally insulating material.

48. A cooling mechanism according to claim 44, wherein the thermal insulation means is formed from a separate tubular component made from a thermally insulating material, said tubular component being adapted to be received in the valve port so as to substantially cover the inner surface of the valve port.

49. A cooling mechanism according to claim 48, wherein the outer cylindrical valve element is formed with an inlet valve port and an exhaust valve port, thermal insulation means being provided on both ports so as to reduce heat transfer from the outer cylindrical valve element to the inlet gas through the inlet valve port, and to reduce heat transfer from the exhaust gas to the outer cylindrical valve element through the exhaust port.

50. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising at least one passage formed in the rotary valve cylinder through which, in use, cooling fluid flows, the cooling mechanism further comprising thermal insulation means at an inner surface of the valve port formed on the outer cylindrical valve element, the thermal insulation means being operative to minimize the thermal energy transferred between the outer cylindrical valve element and any gas flowing through the port.

51. A cooling mechanism for a rotary valve cylinder engine comprising a rotary valve cylinder rotatably mounted within an outer cylindrical valve element, the rotary valve cylinder and the outer cylindrical valve element each being formed with a respective valve port, the rotary valve cylinder being rotatable relative to the outer cylindrical valve element to a position in which the ports are aligned, the cooling mechanism comprising a heat sink mounted directly to an upper part of the rotary valve cylinder so as to rotate with the rotary valve cylinder, the heat sink being otherwise exposed to the open air, the cooling mechanism further comprising thermal insulation means at an inner surface of the valve port formed on the outer cylindrical valve element, the thermal insulation means being operative to minimize the thermal energy transferred between the outer cylindrical valve element and any gas flowing through the port.

* * * * *

UNITED STATES PATENT AND TRADEMARK OFFICE

CERTIFICATE OF CORRECTION

PATENT NO. : 7,406,938 B2
APPLICATION NO. : 10/573111
DATED : August 5, 2008
INVENTOR(S) : K. T. Lawes It is certified that error appears in the above-identified patent and that said Letters Patent is hereby corrected as shown below:

| COLUMN | LINE | ERROR |
|---|---|---|
| 9 (Claim 34, line 1) | 36 | delete "according to", second instance |
| 9 (Claim 35, line 1) | 40 | after "wherein" insert --,-- |
| 10 (Claim 46, line 6) | 34 | "fit gas" should read --the gas-- |

Signed and Sealed this

Seventh Day of April, 2009

John Doll

JOHN DOLL
*Acting Director of the United States Patent and Trademark Office*